US011286732B1

(12) United States Patent
Teodorescu

(10) Patent No.: US 11,286,732 B1
(45) Date of Patent: Mar. 29, 2022

(54) FILTER SUB

(71) Applicant: Stabil Drill Specialties, L.L.C., Lafayette, LA (US)

(72) Inventor: Sorin Gabriel Teodorescu, The Woodlands, TX (US)

(73) Assignee: Stabil Drill Specialties, L.L.C., Lafayette, LA (US)

( * ) Notice: Subject to any disclaimer, the term of this patent is extended or adjusted under 35 U.S.C. 154(b) by 203 days.

(21) Appl. No.: 16/392,066

(22) Filed: Apr. 23, 2019

Related U.S. Application Data

(60) Provisional application No. 62/661,764, filed on Apr. 24, 2018.

(51) Int. Cl.
*E21B 21/00* (2006.01)
*E21B 43/08* (2006.01)

(52) U.S. Cl.
CPC ..... *E21B 21/002* (2013.01); *E21B 43/086* (2013.01)

(58) Field of Classification Search
CPC ..... E21B 21/002; E21B 43/086
See application file for complete search history.

(56) References Cited

U.S. PATENT DOCUMENTS 1,634,547 A * 7/1927 Losack ..... E21B 43/088 166/233
3,219,193 A * 11/1965 Techler ..... B01D 29/111 210/497.1
3,431,975 A * 3/1969 Blake ..... E21B 43/086 166/227
3,450,207 A * 6/1969 Abraham ..... E21B 43/086 166/233
3,584,685 A * 6/1971 Boyd ..... B01D 29/15 166/231
3,713,541 A * 1/1973 Nelson ..... D21D 5/06 210/415
9,677,361 B2 6/2017 Patterson
2003/0062170 A1* 4/2003 Slack ..... E21B 43/086 166/377
2003/0150616 A1* 8/2003 Mashburn ..... E21B 27/005 166/311
2010/0236833 A1* 9/2010 Hall ..... E21B 27/005 175/314
2014/0116681 A1* 5/2014 Broussard ..... E21B 27/005 166/227
2015/0158196 A1* 6/2015 Hayden ..... B24C 1/045 405/43

* cited by examiner

*Primary Examiner* — Steven A MacDonald
(74) *Attorney, Agent, or Firm* — Jones Walker LLP

(57) ABSTRACT

A filter sub which includes a tubular sub housing and a strainer insert. The strainer insert has (i) a tubular strainer body, (ii) a plurality of helical grooves formed through a sidewall of the strainer body, and (iii) at least one of the helical grooves extending at least 360° around the strainer body.

19 Claims, 3 Drawing Sheets

FILTER SUB

CROSS-REFERENCE TO RELATED APPLICATION

This application claims the benefit under 35 USC § 119(e) to U.S. Provisional Application Ser. No. 62/661,764 filed Apr. 24, 2018, which is incorporated by reference herein in its entirety.

BACKGROUND

The present invention relates generally to filtering devices, and more particularly, filtering devices that form part of a drill string operating in oil and/or gas wellbores.

The use of drilling fluids in the process of drilling wellbores is well known. The drilling fluid serves numerous purposes, including, for example, suppressing formation pressure, lubricating the drill string, flushing drill cuttings away from the drill bit, cooling of the bottom hole assembly, driving turbines that provide power for various downhole tools, and powering downhole hydraulic drilling motors. Such drilling fluids are typically pumped down through the tubular drill string to the drill bit and circulated back to the surface in the annular region between the drill string and the borehole wall. The circulating drilling fluid typically carries drill cuttings, metal shavings, and other debris to the surface. Large particles, having a size that may damage sensitive downhole turbines, hydraulic motors or plug drill bit jets are preferably removed from the drilling fluid before recycling back into the borehole.

Although various filter equipment is employed at the surface to remove debris from the drilling fluid before it is pumped back downhole, it is often desirable to have a redundant filtering mechanism incorporated into the drill string. Typically, this downhole filtering mechanism is provided as a separate tubular member or "sub" positioned near the bottom hole assembly of the drill string and is referred to as a filter sub. Conventional filter subs often are formed by a slotted filter insert positioned within a filter sub housing such that drilling fluids flow through the insert and debris is retained by the slots. However, because of the high flow rates and pressures, in addition to the abrasive nature of hard particles carried by drilling fluids, erosion of the filter insert can significantly reduce its serviceable life. A filter sub which can reduce more pronounced local fluid velocities and otherwise reduce erosion within the tool may significantly increase the serviceable life of the filter insert.

SUMMARY OF SELECTED EMBODIMENTS

One embodiment of the present invention is a filter sub which generally includes a tubular sub housing and a strainer insert. The strainer insert has (i) a tubular strainer body, (ii) a plurality of helical grooves formed through a sidewall of the strainer body, and (iii) at least one of the helical grooves extending at least 360° around the strainer body.

In another embodiment, the helical grooves have an increasing pitch along a length of the strainer body.

In a still further embodiment, the tubular strainer body is inwardly tapering.

DETAILED DESCRIPTION OF SELECTED EMBODIMENTS

Figure 1A:
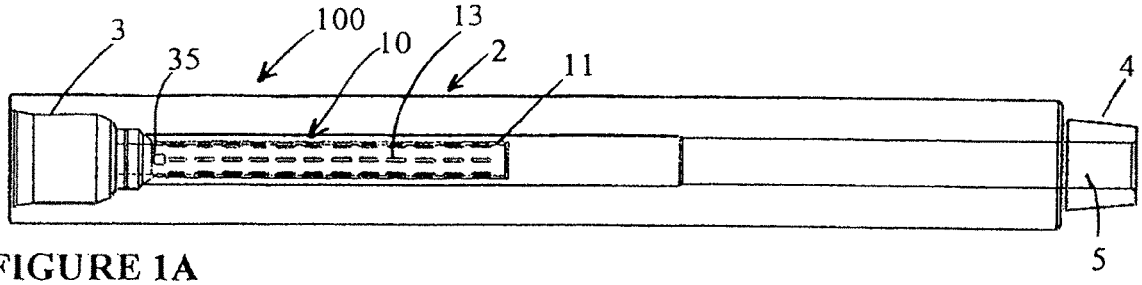
FIG. 1A illustrates a prior art filter sub.
Figure 1B:
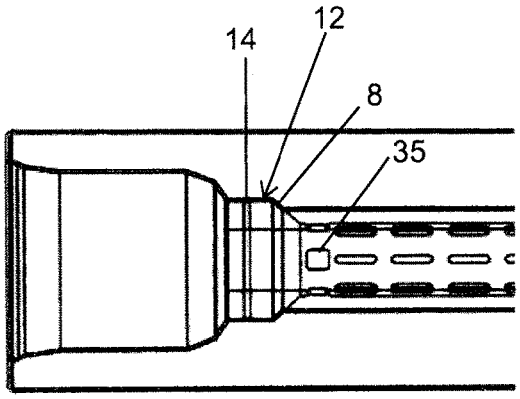
FIG. 1B illustrates the upper end of the strainer insert seen in FIG. 1.
Figure 1C:
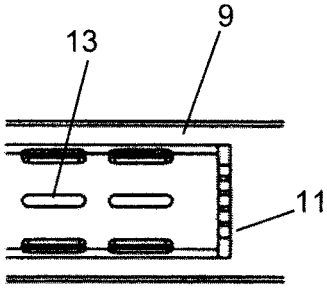
FIG. 1C illustrates the lower end of the strainer insert seen in FIG. 1.
Figure 2:
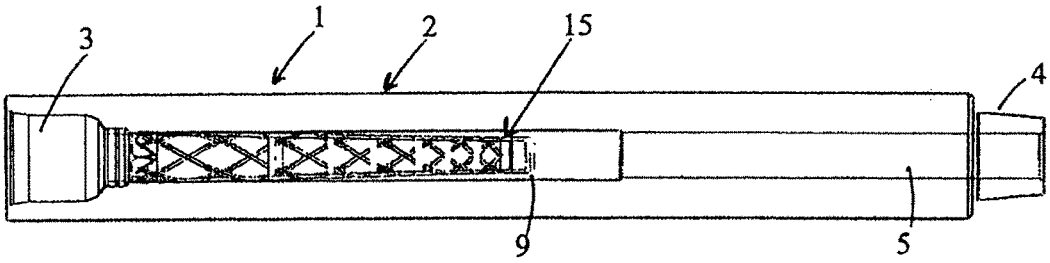
FIG. 2 illustrates a cross-section view of one embodiment of the strainer insert positioned in a sub housing according to the present invention.

FIGS. 1A to 1C illustrate one example of a prior art filter sub 100. Most generally, the filter sub 100 is formed of the sub housing 2 and the strainer insert 10 positioned within sub housing 2. The sub housing 2 seen in FIG. 1A includes conventional box threads 3 on a first or "upper" end of the housing 2 and convention pin threads 4 on the second or "lower" end of the housing 2. The terms "upper" and "lower" are defined in terms of the direction of fluid flow, i.e., fluid flows from the tool's upper end toward its lower end. The sub central passage 5 extends completely through the housing in order to allow the circulation of drilling fluids through the sub housing 2. The strainer insert 10 is a tubular body with a series of slots 13 formed in the wall of and around the circumference of the tubular body. As best seen in FIG. 1B, strainer insert 10 includes a head section 12 which engages the mounting shoulder 8 of sub housing 2. The seals 14 prevent fluid flow between the outer diameter of strainer head section 12 and the inner diameter of sub housing 2. Immediately below the head section 12 is shown the overflow port 35. One or more overflow ports 35 may be included when it is expected to have high debris or "junk" volume, due to motor components wearing out and/or improper filtration at the shale shaker screen level. Opposite head section 12 on the insert tubular body is the end section 11. Although not seen in the drawings, the front of end section 11 (i.e., the portion of end section 11 positioned perpendicular to central passage 5) will have a face plate. Typically this face plate in prior art strainer inserts will have a series of apertures formed therein to allow some degree of fluid flow through the end section.

In operation, drilling fluid (e.g., a drilling mud) will enter the sub housing central passage through the tubular string connected to the box threads of the sub housing. The drilling fluid is directed into the interior of the filter insert tubular body and forced to flow out of the insert tubular body through the slots 13 and any apertures in the face of end section 11. As suggested in FIG. 1C, the larger inner diameter of sub housing 2 adjacent to end section 11 of the filter insert creates an annular flow gap 9 between the OD of filter insert 10 and ID of the sub housing 2. This flow gap allows drilling fluid exiting the slots 13 to flow around end section 11 of filter insert 10 and exit the central passage at the pin thread end of the sub housing 2. Naturally, fluid exiting the apertures of end section 11's face plate has a direct flow path to the central passage at the pin thread end of the sub housing. Any debris which is too large to move through the slots 13 (or apertures in the end section face plate) is retained within the filter insert.

Figure 3:
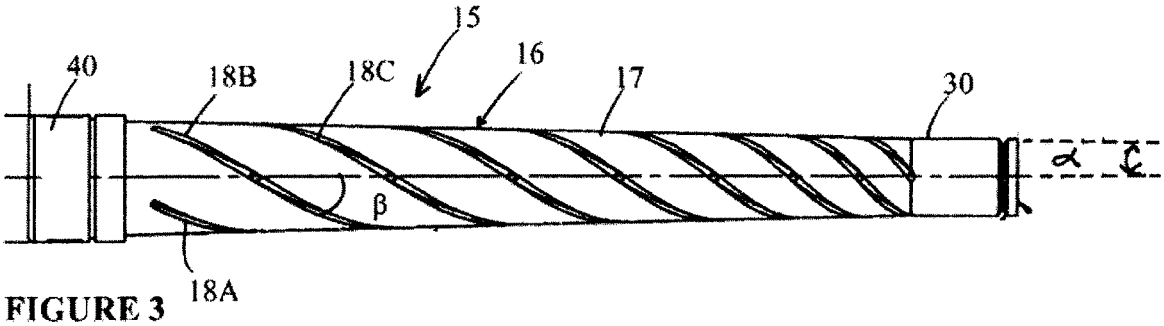
FIG. 3 illustrates a side view of the strainer insert seen in FIG. 2.

FIGS. 2 to 5 illustrate certain embodiments of the filter sub 1 of the present invention. Filter sub 1 is most generally formed by sub housing 2 and strainer insert 15. Sub housing 2 (sometimes referred to as a "tubular sub housing") is similar to that seen in FIG. 1A in that it includes box threads 3, pin threads 4, and the central passage 5. It can also be seen that the inner diameter of central passage 5 is greater than the outer diameter of strainer insert 15 (at least at the smaller diameter end of strainer insert 15), thereby creating the flow gap 9. FIG. 3 shows an enlarged side view of a slightly different embodiment of strainer insert 15 removed from sub housing 2. Strainer insert 15 has a tubular strainer body 16 with a head or strainer head 40 on a first (or "upper") end, a solids capture volume 30 (or solids capture cup or endcap) on a second (or "lower") end, and at least one helical groove (or slot) 18 formed through and extending around the walls of strainer body 16.

The outer diameter (OD) of strainer head 40 will normally be sized to fit within a standard oilfield tubular acting as the sub housing 2. Typical examples of the OD of strainer head 40 could be 4¾", 6½", 6¾", or 8". The inner diameter of the strainer insert at this end may be in certain embodiments 60% to 90% of the sub housing's inner diameter, with certain specific examples running from 2.5" to 3.7". The length of the strainer body 16 in many embodiments is between 20" and 50", but other embodiments could have a length outside this range. In preferred embodiments, the filter insert is formed of an erosion resistant steel with a Brinell hardness of at least 300.

Figure 4:
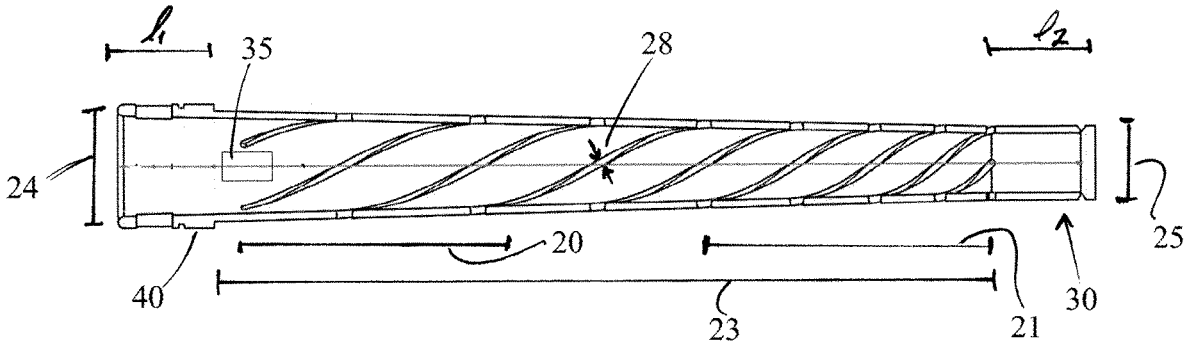
FIG. 4 illustrates a cross-section view of the FIG. 3 strainer insert.

As best seen in FIG. 4, strainer head 40 will have a length $l_1$ that in many embodiments will range between about 0.5" and 2.0". In preferred embodiments, the inner diameter (ID) of the strainer head along the length $l_1$ is substantially constant or has no substantial taper. An insubstantial taper includes one which is less than the taper of the strainer body as described below. The figures also illustrate how many embodiments of strainer body 16 tapers "inward" from a larger diameter at the end of strainer head 40 (where grooves 18 begin) to a smaller diameter at solids capture volume 30 (where grooves 18 end). In FIG. 3, the degree of this inward taper is suggested by the angle "alpha" formed between the centerline of the strainer insert body and a line running along the outer sidewall of the insert body. In particular examples, this inward taper is at an angle alpha of between about 2.5° and about 15°. This angle may also be considered in terms of the point at which the fluid path transitions from the untapered ID of strainer head 40 to the tapered portion of strainer body 16 and may also be referred to as the "fluid impingement angle." For comparatively high fluid flow rates (e.g., 1000 to 1400 gpm) the fluid impingement angle is preferably about 2.5° and it is matched with the pitch of the helical slot, which can vary from 3 inches per turn to 30 inches per turn. For lower flow rates, the fluid impingement angle may be closer to 10°. However, despite the above description of tapered strainer bodies in many preferred embodiments, there could also be embodiments where the strainer body does not taper along its length.

The FIG. 3 embodiment shows the strainer insert 15 as having a series of spiral or helical grooves or slots 18A, 18B, 18C, etc. extending around strainer body 16. The grooves 18 are formed completely through the sidewall of strainer body 16 such that fluid may flow through the grooves from the interior of strainer body 16 to its exterior. The number of grooves 18 will typically range between 1 and 6, but could conceivably be more in specialized embodiments. In a preferred embodiment, helical grooves 18 will extend at least 180° around strainer body 16, e.g., approaching a complete revolution around the strainer body (e.g., anywhere from 180° to 360°). However, there could be alternative embodiments where some or all of the grooves 18 extended less than 180° around strainer body 16 (e.g., anywhere from 90° to 180°).

FIG. 3 differs slightly from embodiments seen in the other figures considering FIG. 3 does not include any overflow ports 35. In many embodiments where the filter sub will not be employed in a "high flow" environment, the overflow ports 35 may be considered unnecessary. As one example, a high flow environment would be one where the drilling fluid is pumped through the filter sub at flow rates over about 1,400 to 1,600 gallons per minute (gpm) and at pressures over about 4,500 pounds per square inch (psi).

As best seen in FIG. 4, certain embodiments of filter insert 15 will have the pitch of the helical grooves vary along a length of the strainer body. The "pitch" will generally be described in terms of what fraction of a revolution the groove advances per inch of length (revolutions per inch or rev/in). As will be apparent from the figures, the illustrated embodiments show the pitch of the helical grooves becoming increasingly tighter as the grooves move from strainer head 40 toward capture volume 30. In many embodiments, the pitch will range between about 0.033 rev/in and about 0.333 rev/in and may depend on the length 23 of the strainer body 16 and its overall diameter (e.g., the greater the length/dimeter, the smaller the pitch). As two non-limiting examples, for a 50" long strainer body, the initial pitch along the upper length 20 of strainer body 16 is 0.033 rev/in and increases (becomes tighter) along strainer body until the lower length 21 has a final pitch of 0.100 rev/in. For a strainer body 16 with a length of 20", initial pitch along the upper length 20 of strainer body 16 is 0.100 rev/in and increases along strainer body until the lower length 21 has a final pitch of 0.333 rev/in. In many embodiments, the increase in pitch is linear (e.g., steadily increasing) along the length strainer body 16. However, there could be embodiments where the change in pitch is not linear. The width 28 of the grooves 18 (i.e., the width of cut in the wall of strainer body 16) will often range between about 0.1" and about 0.5", with the smaller width obviously retaining smaller sized debris in the drill fluid. One preferred groove width is 0.25".

Although the pitch of the helical grooves 18 may be described in terms of rev/in as in the preceding paragraph, the pitch of the helical grooves may also be described in terms of the "helical angle" beta (β) shown in FIG. 3. The helical angle β provides the angular direction of the grooves with respect to the centerline of the filter insert 15. In many embodiments, the helical angle of the grooves may range (inclusively) between about 15° and about 60°. As with the pitch as defined in rev/in, the helical angle will, in many embodiments, become greater as the as the grooves move from strainer head 40 toward capture volume 30.

Figure 5:
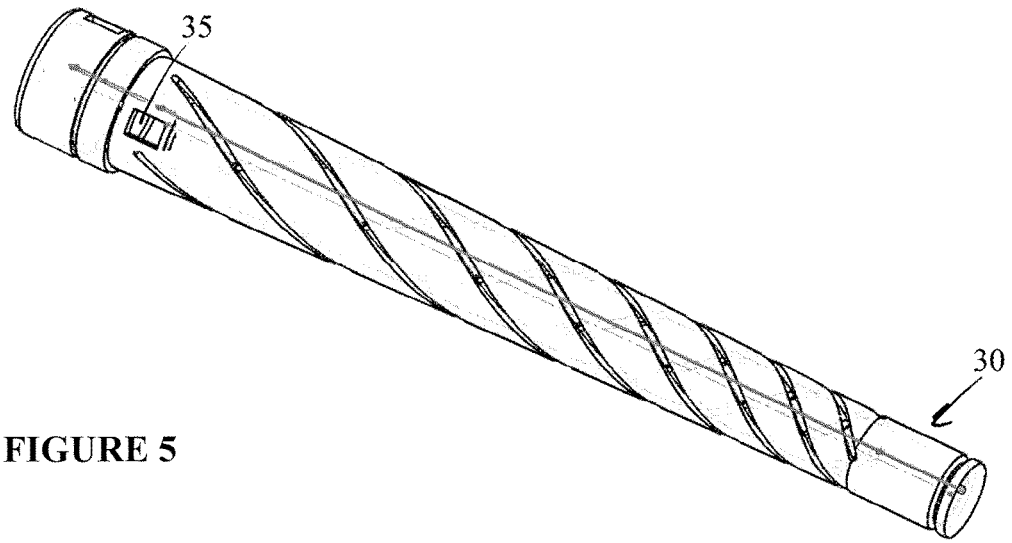
FIG. 5 illustrates a perspective view of the FIG. 3 strainer insert.

As seen in FIGS. 4 and 5, the helical grooves 18 terminate at a solids capture volume 30 on the end of the strainer body 16. In the illustrated embodiment, the length 12 of the solids capture volume 30 is between 10% and 25% of the overall length of the strainer body 16 (e.g., about 2" to about 4") and the solids capture volume has no flow apertures formed in the flat face of the solids capture volume or endcap, i.e., fluid does not exit out of this embodiment of solids capture volume 30.

Figure 6:
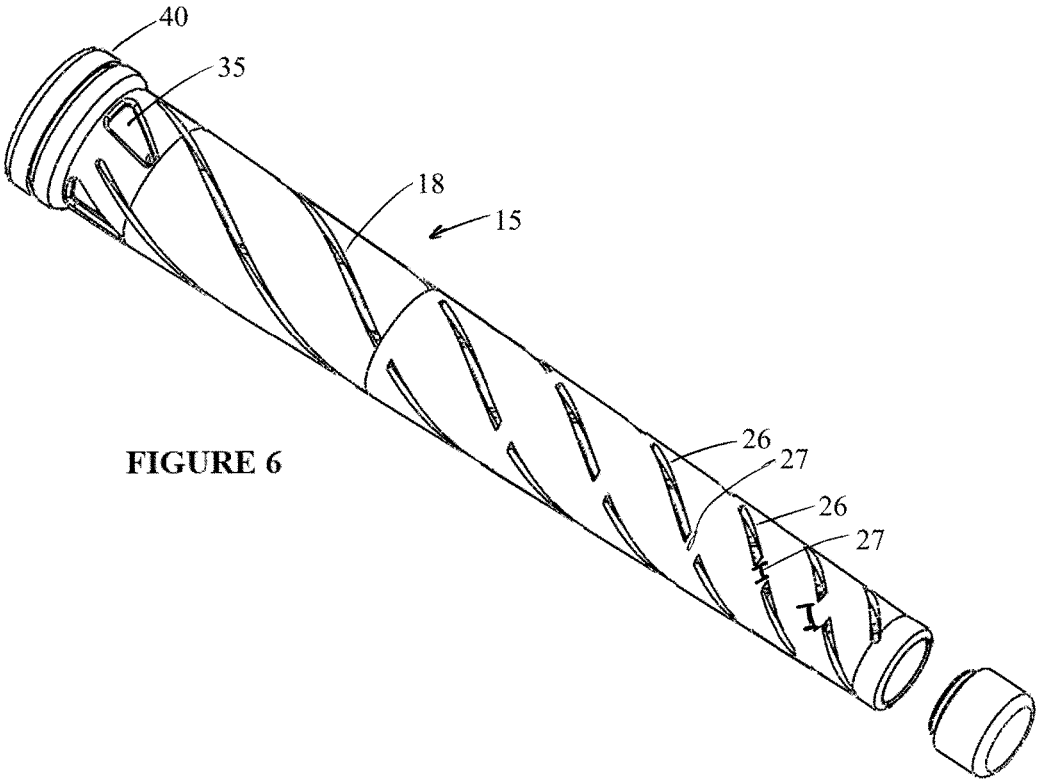
FIG. 6 illustrates a perspective view of a second embodiment of the strainer insert.
Figure 7:
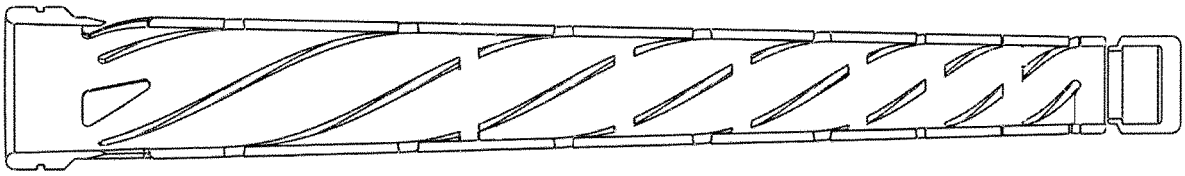
FIG. 7 illustrates a cross-section view of the FIG. 6 embodiment of the strainer insert.

FIGS. 6 and 7 illustrate another embodiment of strainer insert 15. In this embodiment at least one (and more typically all) of the helical grooves 18 includes a plurality of groove segments 26 separated by discontinuities 27 as the groove extends around the strainer body. In essence, the discontinuities 27 are sections along the groove path where the grooves have not been cut through the strainer body. In many embodiments, the groove segments 26 are between three and ten times longer than the discontinuities 27. In practical terms, this results in the discontinuities typically being between 0.25" and 1.25" inches in length, with one preferred embodiment having discontinuities 0.7" in length. FIGS. 6 and 7 also suggest how the discontinuities generally exist within a lower two-thirds of the length of the filter insert. It can be seen that the grooves 18 on the upper one-third of the insert body, by contrast, are continuous. It can also be seen in the illustrated embodiment that the groove segments become shorter as the groove extends further downward along the length of the strainer body. The discontinuities are typically located along the areas of the strainer body where the fluid pressure generates the points of highest stress on the strainer body.

It has been found that as debris accumulates in the lower end of the insert body, continuous grooves in the insert body may sometimes lead to a tendency for the insert body to torsionally oscillate and potentially elongate. Leaving discontinuities 27 along the path of the grooves adds stability and rigidity to the insert body.

FIG. 6 also shows somewhat different overflow port 35. This embodiment of overflow port 35 is substantially triangular in shape with two longer sides generally oriented along a length of the strainer body and a shorter side generally perpendicular to the length of the strainer body. The flow port is oriented such that the shorter side of the port forms a base of the triangle which is located upwards (on the strainer body) of an apex of the triangle. One of the triangle's longer sides is oriented substantially parallel to the helical grooves, while the other of the triangle's longer sides is oriented between the line parallel to the helical grooves and the central axis of the strainer body. In the illustrated embodiment, the longer sides are between 1.7" and 1.8" in length and the shorter side is between 1.2" and 1.3" in length. It has been found that this triangular shaped overflow port tends to minimize flow disturbances caused by fluid exiting rectangular flow ports such as seen in FIGS. 4 and 5.

It also has been found that the helical grooves tend to impart a spin or vortex-like flow pattern to fluid traveling through the strainer body. This vortex-like flow pattern acts to more equally distribute pressure over the strainer body and lessens localized high pressure points which result in more rapid erosion of the strainer body material at the high pressure points.

The term "about" as used herein will typically mean a numerical value which is approximate and whose small variation would not significantly affect the practice of the disclosed embodiments. Where a numerical limitation is used, unless indicated otherwise by the context, "about" means the numerical value can vary by +/−5%, +/−10%, or in certain embodiments +/−15%, or possibly as much as +/−20%. Similarly, the term "substantially" will typically mean at least 85% to 99% of the characteristic modified by the term. For example, "substantially all" will mean at least 85%, at least 90%, or at least 95%, etc.

While the present invention has been described in terms of specific embodiments, those skilled in the art will recognize many alternate embodiments intended to fall within the scope of the following claims.

The invention claimed is:

1. A filter sub configured for assembly with a tubular string to be used in a wellbore, the filter sub comprising:

(a) a tubular sub housing;

(b) a strainer insert positioned within the sub housing, the strainer insert including (i) a tubular strainer body, (ii) a plurality of helical grooves formed through a sidewall of the strainer body, (iii) the helical grooves having a helix angle between 15° and 60°, and (iv) at least one of the helical grooves extending at least 180° around the strainer body.

2. The filter sub of claim 1, wherein multiple of the helical grooves extend at least 360° around the strainer body.

3. The filter sub of claim 1, wherein a pitch of the helical grooves varies along a length of the strainer body.

4. The filter sub of claim 3, wherein the strainer insert has a larger outer diameter end and a smaller outer diameter end, and the pitch becomes increasingly tighter along the length of the strainer body running from the larger outer diameter end to the smaller outer diameter end.

5. The filter sub of claim 4, wherein the increase in pitch is linear.

6. The filter sub of claim 1, wherein the helical grooves terminate at a solids capture volume on an end of the strainer body.

7. The filter sub of claim 6, wherein a length of the solids capture volume is between 10% and 25% of a length of the strainer body.

8. The filter sub of claim 6, wherein the solids capture volume has no flow apertures formed in the capture volume.

9. The filter sub of claim 1, wherein the strainer body is inwardly tapered.

10. The filter sub of claim 9, wherein the strainer body inwardly tapers at an angle of between 2.5° and 15°.

11. The filter sub of claim 1, wherein at least one of the helical grooves comprises a plurality of groove segments separated by discontinuities as the groove extends around the strainer body.

12. The filter sub of claim 11, wherein the groove segments are between three and ten times longer than the discontinuities.

13. The filter sub of claim 12, wherein the filter insert has a length and the discontinuities exist within a lower two-thirds of the length.

14. The filter sub of claim 13, wherein the groove segments become shorter as the groove extends down the length of the strainer body.

15. The filter sub of claim 1, wherein the strainer body includes at an upper end a flow port, the flow port being substantially triangular in shape with two longer sides generally oriented along a length of the strainer body and a shorter side generally perpendicular to the length of the strainer body.

16. The filter sub of claim 1, wherein a mud-motor and a drill bit are connected to the filter sub in a configuration allowing drilling fluid to pass through the strainer insert and into the mud motor in order to drive the drill bit.

17. The filter sub of claim 1, wherein the helical grooves are configured to impart a vortex-like flow pattern to fluid flowing through the strainer body, thereby more equally distributing pressure over the interior of the strainer body and reducing erosion of the strainer body.

18. A filter sub for use in a drill string for creating a wellbore, the filter sub comprising:

(a) a tubular sub housing;

(b) a strainer insert positioned within the sub housing, the strainer insert including (i) a tubular strainer body, (ii) a plurality of helical groove formed through a sidewall of the strainer body, (iii) the helical grooves having a helix angle between 15° and 60°, and (iv) the helical grooves having an increasing pitch along a length of the strainer body.

19. A filter sub configured for assembly with a tubular string to be used in a wellbore, the filter sub comprising:

(a) a tubular sub housing;

(b) a strainer insert positioned within the sub housing, the strainer insert including (i) a tubular strainer body, (ii) a plurality of helical grooves formed through a sidewall of the strainer body, (iii) the helical grooves having an initial pitch of no less than 0.033 rev/in and a final pitch of no more than 0.333 rev/inch, and (iv) at least one of the helical grooves extending at least 180° around the strainer body.

* * * * *